US008978607B2

(12) United States Patent
Weber et al.

(10) Patent No.: US 8,978,607 B2
(45) Date of Patent: Mar. 17, 2015

(54) DEVICE FOR VARIABLY ADJUSTING THE CONTROL TIMES OF GAS EXCHANGE VALVES OF AN INTERNAL COMBUSTION ENGINE

(75) Inventors: Jürgen Weber, Erlangen (DE); Rainer Ottersbach, Aurachtal (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 235 days.

(21) Appl. No.: 13/581,382

(22) PCT Filed: Jan. 25, 2011

(86) PCT No.: PCT/EP2011/050970

§ 371 (c)(1),
(2), (4) Date: Oct. 8, 2012

(87) PCT Pub. No.: WO2011/104054

PCT Pub. Date: Sep. 1, 2011

(65) Prior Publication Data

US 2013/0047943 A1 Feb. 28, 2013

(30) Foreign Application Priority Data

Feb. 26, 2010 (DE) ..... 10 2010 009 393

(51) Int. Cl.
*F01L 1/34* (2006.01)
*F01L 1/344* (2006.01)

(52) U.S. Cl.
CPC ..... *F01L 1/3442* (2013.01); *F01L 2810/01* (2013.01)
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 6,269,785 | B1 | 8/2001 | Adachi | |
| 6,378,475 | B2 * | 4/2002 | Takenaka et al. | 123/90.17 |
| 6,520,132 | B2 * | 2/2003 | Todo | 123/90.17 |

(Continued)

FOREIGN PATENT DOCUMENTS

| | | |
|---|---|---|
| CN | 101293577 | 10/2008 |
| DE | 19742947 | 4/1998 |

(Continued)

*Primary Examiner* — Thomas Denion
*Assistant Examiner* — Steven D Shipe
(74) *Attorney, Agent, or Firm* — Volpe and Koenig, P.C.

(57) ABSTRACT

A device (11) for variably adjusting the control times of gas exchange valves (9, 10) of an internal combustion engine (1), including a drive element (13) that can be brought into driven connection with a crankshaft (2) of the internal combustion engine (1), an output element (14) which can be brought into driving connection with a camshaft (6, 7) of the internal combustion engine (1) and which is arranged in a pivotable manner with respect to the drive element (13), and at least one lateral cover (15) which lies on an axial lateral surface of the output element (14) or of the drive element (13), which is connected to the drive element (13) or to the output element (14) in a rotationally fixed manner and which has a disk-shaped portion (33). The disk-shaped portion (33) has a sliding guide depression (36*c*) which is open to the drive or output element (13, 14), said sliding guide depression being equipped with a stop element (40), and the sliding guide depression (36*c*) and the stop element (40) form a sliding guide into which a locking element (38) can engage.

8 Claims, 3 Drawing Sheets

(56) References Cited

U.S. PATENT DOCUMENTS

| | | | | |
|---|---|---|---|---|
| 7,706,955 | B2 * | 4/2010 | Ichimoto et al. | 701/102 |
| 7,956,564 | B2 * | 6/2011 | Morino | 318/484 |
| 8,245,677 | B2 * | 8/2012 | Kleiber | 123/90.17 |
| 8,387,578 | B2 * | 3/2013 | Fischer | 123/90.17 |
| 8,499,731 | B2 * | 8/2013 | Burkard et al. | 123/90.15 |
| 2001/0054405 | A1 * | 12/2001 | Miyasaka | 123/90.17 |
| 2001/0054406 | A1 * | 12/2001 | Okada et al. | 123/90.17 |
| 2002/0050257 | A1 * | 5/2002 | Watanabe | 123/90.17 |
| 2002/0062802 | A1 * | 5/2002 | Saito et al. | 123/90.17 |
| 2002/0139332 | A1 * | 10/2002 | Takenaka | 123/90.17 |
| 2002/0139333 | A1 * | 10/2002 | Kusano et al. | 123/90.17 |
| 2003/0062011 | A1 | 4/2003 | Hori | |
| 2003/0217716 | A1 | 11/2003 | Kusano et al. | |
| 2004/0226527 | A1 * | 11/2004 | Borraccia et al. | 123/90.17 |
| 2006/0081204 | A1 | 4/2006 | Bilic et al. | |
| 2007/0175426 | A1 * | 8/2007 | Knecht et al. | 123/90.17 |
| 2007/0251475 | A1 * | 11/2007 | Suga et al. | 123/90.17 |
| 2009/0173298 | A1 * | 7/2009 | Hayashi | 123/90.17 |
| 2011/0017156 | A1 * | 1/2011 | Smith | 123/90.15 |
| 2011/0079189 | A1 * | 4/2011 | Burkard et al. | 123/90.17 |
| 2012/0103289 | A1 * | 5/2012 | Kato et al. | 123/90.15 |
| 2012/0285407 | A1 * | 11/2012 | Watanabe | 123/90.17 |
| 2013/0186356 | A1 * | 7/2013 | Schelter | 123/90.15 |
| 2013/0269639 | A1 * | 10/2013 | Weber | 123/90.15 |

FOREIGN PATENT DOCUMENTS

| | | |
|---|---|---|
| DE | 102006020314 | 11/2007 |
| DE | 102009000683 | 8/2009 |

* cited by examiner

DEVICE FOR VARIABLY ADJUSTING THE CONTROL TIMES OF GAS EXCHANGE VALVES OF AN INTERNAL COMBUSTION ENGINE

FIELD OF THE INVENTION

The invention relates to a device for variably adjusting the control times of gas exchange valves of an internal combustion engine, comprising a drive element which can be placed in a driven connection with a crankshaft of the internal combustion engine, an output element which can be placed in a driving connection with a camshaft of the internal combustion engine and is arranged pivotably with respect to the drive element, and comprising at least one side cover which is arranged on an axial side face of the output element or of the drive element and is connected in a rotationally fixed fashion to the drive element or the output element and has a disk-shaped section, wherein the disk-shaped section has a sliding guide depression which is open to the drive element or the output element and in which a stop element is arranged, and wherein the sliding guide depression and the stop element form a sliding guide in which a locking element can engage.

BACKGROUND

In modern internal combustion engines, devices for variably adjusting the control times of gas exchange valves are used to be able to variably adjust the phase relation between a crankshaft and a camshaft in a defined angular range, between a maximum advanced position and a maximum retarded position. The device is integrated into a drive train by means of which torque is transmitted from the crankshaft to the camshaft. This drive train may be implemented, for example, as a belt drive, chain drive or gearwheel drive. Furthermore, the device is connected in a rotationally fixed fashion to a camshaft and can have, for example, one or more pressure chambers by means of which the phase relation between the crankshaft and the camshaft can be varied selectively by applying a pressure medium.

A device of this type is known, for example, from DE 10 2006 020 314 A1. The device has a drive element, an output element and two side covers, wherein the drive element has a driven connection from a crankshaft, and the output element is attached in a rotationally fixed fashion to a camshaft. The output element is arranged so as to be pivotable with respect to the drive element in a predefined angular interval. The drive element, the output element and the side covers bound a plurality of pressure spaces which are divided by vanes into pressure chambers which act against one another. The pressure chambers form a hydraulic actuator drive by means of which the phase angle between the output element and the drive element can be adjusted in a variable fashion. The side covers are arranged on the axial side faces of the output element and of the drive element and are connected in a rotationally fixed fashion to the drive element by means of screws. In order to apply pressure medium to the pressure chambers, drilled holes are provided in the output element, said drilled holes starting from a central opening in the output element, running in the radial direction and opening into the pressure chambers.

The device has a locking mechanism which comprises a sliding guide and a spring-loaded locking element. The sliding guide is formed by a depression in the side cover which is embodied as a solid cast part and a hardened insertion element which is arranged in the depression. In order to ensure a flush termination between the axial side face of the side cover and the insertion element, the depression must be worked in a metal-cutting manner. The locking element is arranged in an axially displaceable fashion inside a receptacle which is formed inside the output element. If the sliding guide and the locking element are located axially opposite one another, the locking element can engage in the sliding guide and couple the output element mechanically to the drive element. In order to release the locked connection, the sliding guide is provided with pressure medium which forces the locking element back into the receptacle. The insertion element makes available a stop face for the locking element, with the result that only the insertion element has to have a high degree of strength and the side cover can be fabricated from more cost-effective materials. The application of force by the insertion element to the side cover is done via contact over a surface, with the result that the load at this point is smaller than in the case of the linear contact between the locking element and the insertion element.

SUMMARY

The present invention is based on the object of proposing a cost-effective device which is optimized in terms of weight.

The object is achieved according to the invention in that a base of the sliding guide depression has a planar stop face against which the stop element bears, wherein the stop face is arranged spaced apart from an edge of the sliding guide depression, and the depth of the stop face is made to be less than a maximum depth of the sliding guide depression.

The device has a drive element and an output element, wherein the drive element is driven by a crankshaft of the internal combustion engine, and the output element drives a camshaft of the internal combustion engine. The drive element can have a driven connection to the crankshaft by means of, for example, a flexible drive or gearwheel drive. The output element can, for example, be connected in a rotationally fixed fashion to the camshaft.

The output element is pivotable with respect to the drive element in a predefined angular interval. For this purpose, the device can, for example, have a hydraulic actuator drive with at least one pressure space.

A side cover is provided on an axial side face of the drive element or of the output element and is connected in a rotationally fixed fashion to one of these components. In this context, the side cover has a disk-shaped section, if appropriate with a central opening, which section seals, for example, the pressure spaces in the axial direction. The disk-shaped section has a sliding guide depression in which a separately fabricated stop element is secured. The sliding guide depression and the stop element form a sliding guide into which a locking element can engage, which locking element is arranged in a component of the device which can pivot with respect to the side cover. If the locking element engages in the sliding guide, the output element is mechanically coupled to the drive element. In this context, the drive torque of the crankshaft is transmitted via the locking element and the stop element from the drive element to the output element. The force is applied, on the one hand, between the locking element and the stop element, generally via a linear contact, and the stop element and an axially extending boundary wall of the sliding guide depression via contact over a surface. In this way, only the locking element and the stop element have to be hardened, and the side cover can be fabricated from more cost-effective materials since the loading due to the contact over a surface between the stop element and the side cover is less.

The base of the sliding guide depression has a planar stop face against which the stop element bears. The stop face is arranged spaced apart from an edge of the sliding guide depression, wherein the depth of the stop face is made less than a maximum depth of the sliding guide depression. In this context it is possible to provide that the depth of the stop face is embodied so as to be less than a depth in the edge region of the sliding guide depression. The edge of the sliding guide depression is to be understood as being the region of the sliding guide depression adjoining the axially extending boundary walls of the sliding guide depression. The depth is understood to be the axial distance between the side face of the disk-shaped section which faces the output element and/or the drive element and the respective point on the base of the sliding guide depression.

The stop face which projects out of the base of the sliding guide depression in a plateau-like fashion ensures that the stop element terminates flush with the side face of the disk-shaped section. The stop face can be embodied with a high level of dimensional accuracy in the manufacturing process of the disk-shaped section. For example it is possible to provide for the disk-shaped section to be manufactured by means of a deep drawing method by means of which at the same time the sliding guide depression and the stop face are formed. Alternatively, the disk-shaped section can be manufactured by means of a deep drawing method by means of which at the same time the sliding guide depression is formed, and the stop face can be subsequently formed by means of a stamping method. The dimensions can be implemented reliably in terms of processing during the manufacturing process so that costly metal-cutting working steps for the sliding guide depression can be eliminated and the stop element nevertheless terminates flush with the side face of the first side cover. The stop face which is spaced apart from the edge of the sliding guide depression and protrudes from the base thereof ensures that during the mounting of the stop element it does not dip into the region of a radius which is formed in the junction region between the base and the axially extending boundary wall of the sliding guide depression. In this way, precise positioning of the stop element in the sliding guide depression is possible, while avoiding damage to the walls. At the same time, a frictionally locking connection can be produced between the axially extending boundary wall and the stop element. Materially joined or positively locking connections are also conceivable. In contrast to cast side covers which are of solid design, in this way it is possible to use a thin-walled sheet-metal cover or a plastic cover, which reduces the weight and the manufacturing costs.

In one advantageous development of the invention it is possible to provide that the sliding guide depression forms a bulge on the side of the disk-shaped section facing away from the drive element. The raising of the outer face improves the cooling of the side cover and therefore lowers the thermal loading.

The stop element advantageously projects beyond the support face in the direction of the sliding guide. The stop element is positioned by bearing against the support face, wherein the support face does not extend into the contact region between the stop element and the locking element. This ensures that the locking element comes to bear exclusively against the stop element, and the force is not transmitted directly between the side cover and the locking element.

The stop element can have, on the side face bearing against the stop face, at least one groove for conducting pressure medium, with the result that, for example, the sliding guide or a pressure medium line leading to one of the pressure spaces can be supplied with pressure medium.

BRIEF DESCRIPTION OF THE DRAWINGS

Further features of the invention emerge from the following description and from the drawings in which an exemplary embodiment of the invention is illustrated in simplified form. In the drawings.

DETAILED DESCRIPTION OF THE PREFERRED EMBODIMENTS

Figure 1:
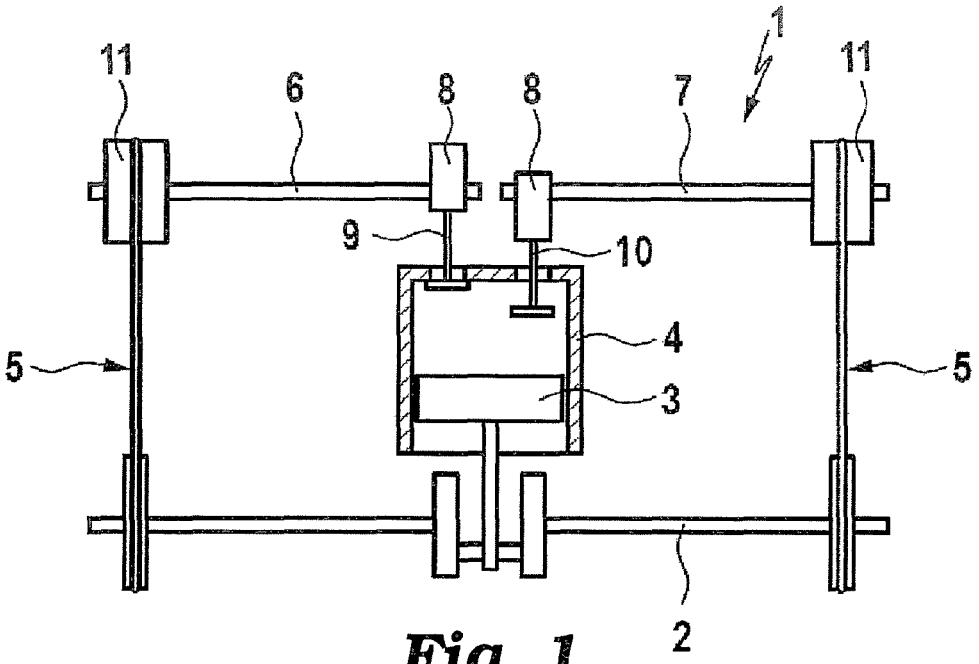
FIG. 1 shows an internal combustion engine in only very schematic form.

FIG. 1 is a schematic diagram of an internal combustion engine 1, wherein a piston 3 which is seated on a crankshaft 2 is indicated in the cylinder 4. In the illustrated embodiment, the crankshaft 2 is connected to an intake camshaft 6 or an exhaust camshaft 7 via a flexible drive 5 in each case, wherein a first and a second device 11 for variably adjusting the control times of gas exchange valves 9, can ensure that there is a relative rotation between the crankshaft 2 and the camshafts 6, 7. Cams 8 of the camshafts 6, 7 activate one or more intake gas exchange valves 9 and/or one or more exhaust gas exchange valves 10.

Figure 3:
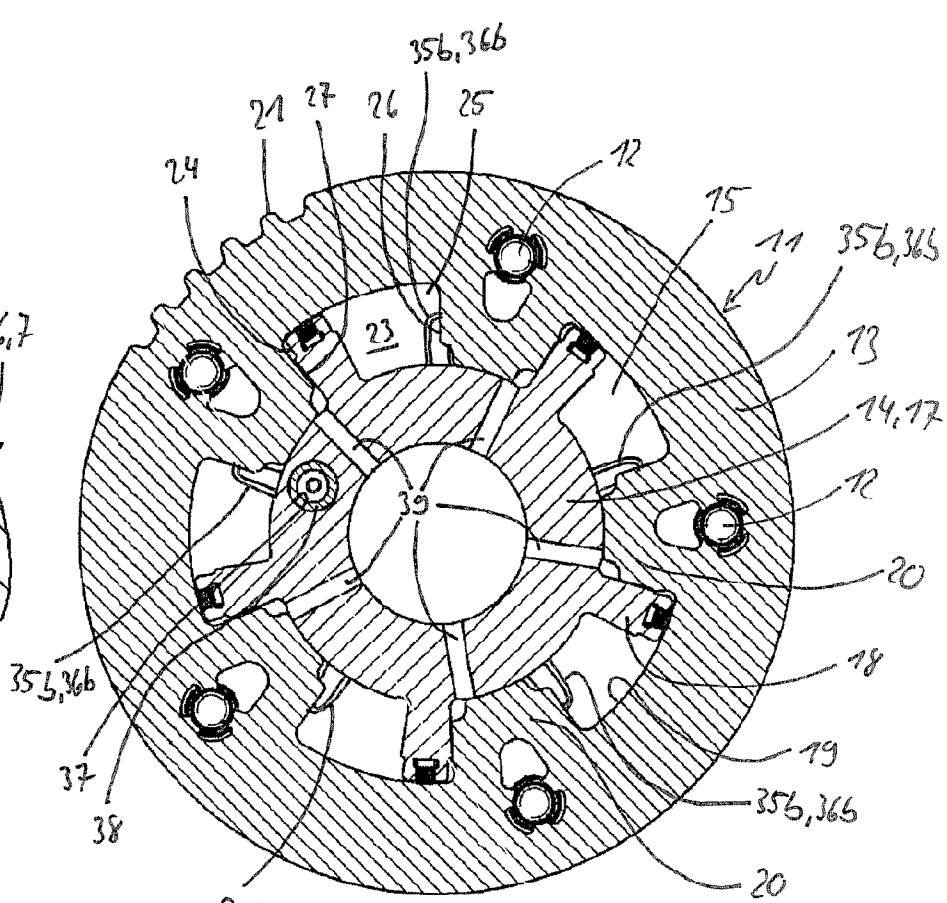
FIG. 3 shows a cross section through the device according to the invention along the line III-III in FIG. 2.
Figure 2:
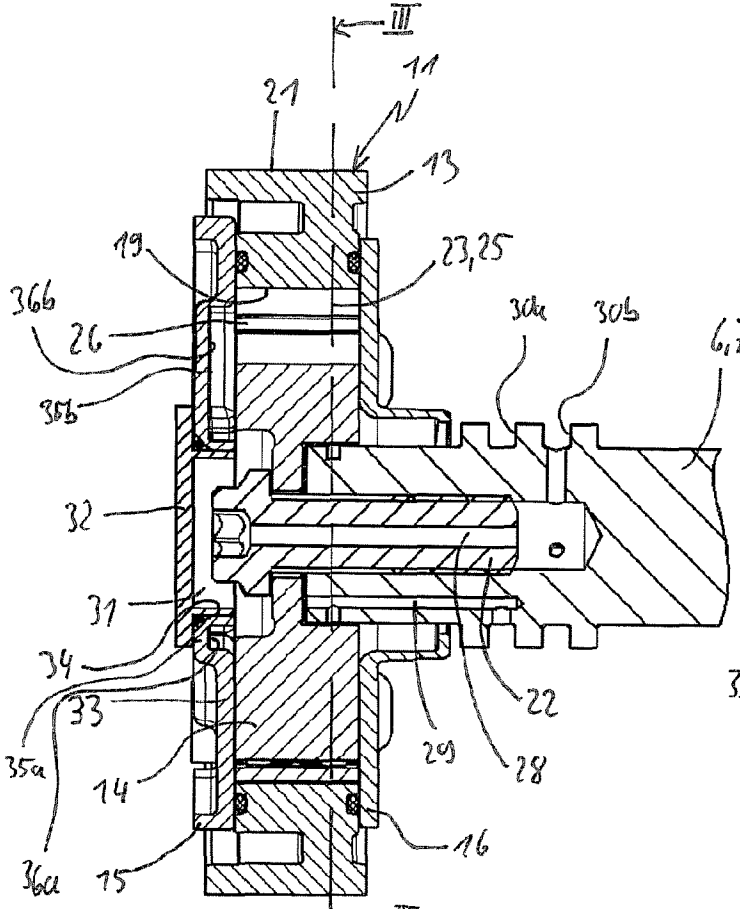
FIG. 2 shows a longitudinal section through a device according to the invention for variably adjusting the control times of gas exchange valves of an internal combustion engine.

FIGS. 2 and 3 show a device 11 according to the invention in a longitudinal section and cross section, respectively. The device 11 has a drive element 13, an output element 14 and two side covers 15, 16 which are arranged on axial side faces of the drive element 13 and are attached thereto by means of screws 12. The output element 14 is embodied in the form of an impeller wheel and has an essentially cylindrically embodied hub element 17, from whose outer cylindrical lateral surface vanes 18 extend outward in the radial direction.

Projections 20 extend radially inward starting from an outer circumferential wall 19 of the drive element 13. The drive element 13 is mounted on the output element 14 in such a way that it is rotatable in relation to said drive element 14 by means of radially inner circumferential walls of the projections 20.

The drive element 13 is provided with a belt pulley 21, via which torque can be transmitted from the crankshaft 2 to the drive element 13 by means of a belt drive (not illustrated). The output element 14 is connected in a rotationally fixed fashion to the camshaft 6, 7 by means of a central screw 22.

Pressure spaces 23 are formed within the device 11, between in each case two projections 20 which are adjacent in the circumferential direction. Each of the pressure spaces 23 is bounded by adjacent projections 20 in the circumferential direction, by the side covers 15, 16 in the axial direction, radially toward the inside by the hub element 17, and radially toward the outside by the circumferential wall 19. A vane 18 projects into each of the pressure spaces 23, wherein the vanes 18 bear both against the side covers 15, 16 and against the circumferential wall 19. Each vane 18 therefore divides the respective pressure space 23 into two pressure chambers 24, 25 which act against one another.

The output element 14 is arranged so as to be rotatable with respect to the drive element 13 in a defined angular range. The angular range is bounded in one rotational direction of the output element 14 by virtue of the fact that each of the vanes 18 comes to bear against an advanced stop 26. In an analogous fashion, the angular range is bounded in the other rotational direction by virtue of the fact that each of the vanes 18 comes to bear against a retarded stop 27.

By applying pressure medium to a group of pressure chambers 24, 25 and relieving the other group of pressure medium, the phase angle of the drive element 13 can be varied with respect to the output element 14 (and therefore the phase angle of the camshaft 6, 7 with respect to the crankshaft 2). By applying pressure medium to both groups of pressure chambers 24, 25, the phase angle can be kept constant.

The camshaft 6, 7 has a central pressure medium line 28 and a plurality of coaxial pressure medium lines 29 which extend in the axial direction. The pressure medium lines 28, 29 communicate with a control valve (not illustrated) via annular grooves 30*a,b* which are formed on an outer lateral face of the camshaft 6,7. The coaxial pressure medium lines 29 communicate with a first group of pressure chambers 24 via radial holes 39.

The central pressure medium line 28 extends through the central screw 22 to the side of the output element 14 facing away from the camshaft 6, 7, and opens into a closed-off space 31 which is sealed off by a closure stopper 32.

Figure 6:
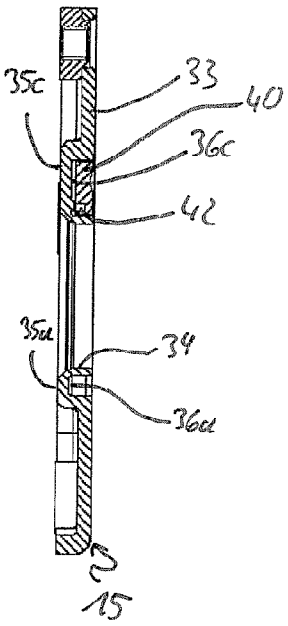
FIG. 6 shows a longitudinal section through the side cover along the line VI-VI in FIG. 4.
Figure 5:
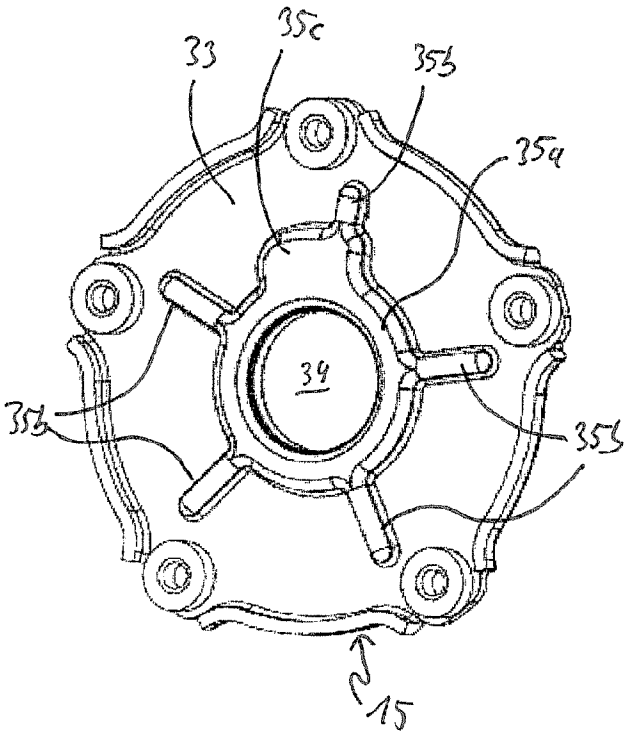
FIG. 5 shows a perspective view of the outside of the side cover from FIG. 4.
Figure 4:
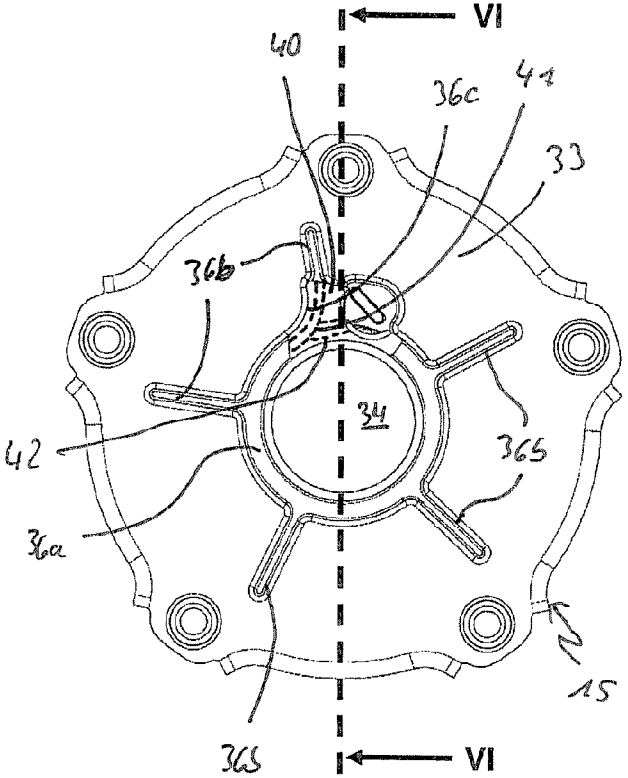
FIG. 4 shows a plan view of a side face of the side cover bearing against the drive element.

FIGS. 4 to 6 show the first side cover 15 in various views. The first side cover 15 has a disk-shaped section 33 with a central opening 34 and is comprised of sheet steel. A plurality of bulges 35*a-c* are formed on the disk-shaped section 33, on the side face facing away from the output element 14 (FIG. 5). A first bulge 35*a* extends in an annular shape around the central opening 34. Furthermore, five second bulges 35*b* are provided which are embodied in the form of ribs and extend radially outward from the first bulge 35*a*. A third bulge 35*c* adjoins the first bulge 35*a* in the region of one of the second bulges 35*b* and covers a part of the disk-shaped section 33 between two of the second bulges 35*b*. The surface of the first side cover 15 is enlarged by the bulges 35*a-c*, with the result that the cooling of the device 11 is improved. Furthermore, during the operation of the internal combustion engine 1, the bulges 35*a-c* generate air turbulence in the region of the first side cover 15, as a result of which the cooling thereof is improved further. Overall, this leads to lower thermal loading of the first side cover 15 and to more effective cooling of the pressure medium present in the device 11, which is generally engine oil of the internal combustion engine 1.

At the same time, the bulges 35*a-c* increase the rigidity of the first side cover 15, as a result of which the sealing of the pressure chambers 24, 25 can be improved or the first side cover 15 can be constructed with thinner walls.

Corresponding first depressions 36*a*, corresponding second depressions 36*b* and a sliding guide depression 36*c* are formed in the region of the bulges 35*a-c*, on the side face of the disk-shaped section 33 facing the output element 14 (FIG. 4). The first depression 36*a* is embodied in the form of an annular duct and communicates with the central pressure medium line 28 via the space 31. The second depressions 36*b* are embodied in the form of radially extending grooves which open into the first depression 36*a* and communicate with a second group of pressure chambers 25.

During the operation of the internal combustion engine 1, pressure medium is fed to the control valve (not illustrated) by means of a pressure medium pump (not illustrated). If a phase adjustment in the direction of advanced control times is requested by the engine controller, pressure medium passes from the control valve (not illustrated) to the first pressure chambers 24 via the annular groove 30*a*, the coaxial pressure medium lines 29 and the radial drilled holes 39. At the same time, pressure medium is carried away from the second pressure chambers 25 to the control valve via the second depressions 36*b*, the first depression 36*a*, the space 31, the central pressure medium line 28 and the annular groove 30*b*, and is discharged from said control valve into a tank of the internal combustion engine 1. As a result, the vanes 18 are forced in the direction of the advanced stops 26, and the control times are adjusted in the advanced direction.

If the engine controller requests a phase adjustment in the direction of retarded control times, pressure medium passes from the control valve (not illustrated) into the second pressure chambers 25 via the annular groove 30*b*, the central pressure medium line 28, the space 31, the first depression 36*a* and the second depressions 36*b*. At the same time, pressure medium is carried away from the first pressure chambers 24 to the control valve via the radial drilled holes 39, the coaxial pressure medium lines 29 and the annular groove 30*a*, and is discharged from said control valve into a tank of the internal combustion engine 1. As a result, the vanes 18 are forced in the direction of the retarded stops 27, and the control times are adjusted in the retarded direction.

The supply of pressure medium to the second pressure chambers 25, and the carrying away of pressure medium therefrom therefore occurs via the first and second depressions 36*a,b*, which are embodied on the disk-shaped section 33 of the first side cover 15. The otherwise customary radial drilled holes within the output element 14, which have to be formed in a blank by means of metal-cutting working steps, can be dispensed with, which significantly reduces the expenditure involved in manufacturing said output element 14.

The device 11 furthermore has a locking mechanism by means of which a detachable mechanical connection can be produced between the output element 14 and the drive element 13. For this purpose, the output element 14 has a receptacle 37 in which an axially displaceable locking element 38 is accommodated. A force is applied to the locking element 38 in the direction of the disk-shaped section 33 by means of a compression spring.

The sliding guide depression 36*c* is fabricated with excess dimensions with respect to the locking element 38 and accommodates a stop element 40. The stop element 40 and the sliding guide depression 36*c* bound a sliding guide in which the locking element 38 can engage when the latter is located opposite the sliding guide in the axial direction. The mechanical coupling between the output element 14 and the drive element 13 is produced in this way. If the coupling is to be disconnected, pressure medium is fed to the sliding guide, said pressure medium forcing the locking element 38 back into the receptacle 37.

Figure 7:
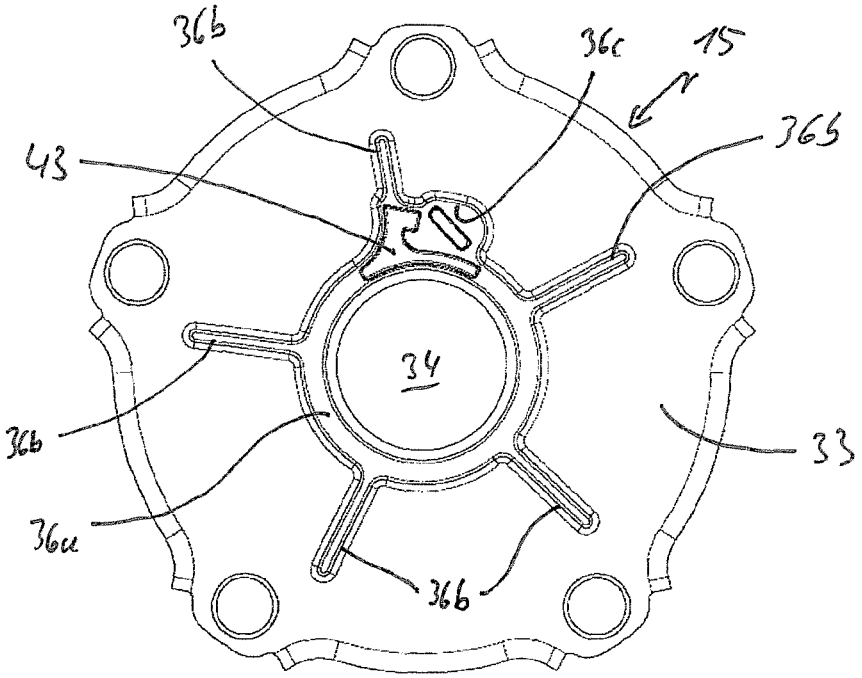
FIG. 7 shows a view of the side cover according to FIG. 4 without a stop element.

The base of the pot-shaped sliding guide depression 36*c* has a planar support face 43 (FIG. 7). The support face 43 is embodied spaced apart from the edge of the sliding guide depression 36*c*, i.e. from the axially extending boundary walls of the sliding guide depression 36. In this context, the depth of the support face 43, i.e. the axial distance from the side face of the disk-shaped section 33 facing the output element 14 is made smaller than the depth of the sliding guide depression 36*c* in the adjacent edge regions, with the result that a groove-shaped cavity which runs around the support face 43 is formed. The stop element 43 is connected in a frictionally locking fashion to the sliding guide depression 36*c*, wherein an axial side face of the stop element 40 bears against the support face 43. The plateau-shaped support face 43 ensures that the stop element 40 does not engage in the edge region of the sliding guide depression 36*c*, which edge region typically has a radius. In this context, the support face 43 advantageously projects beyond the radius region, with the result that the stop element 40 can be joined in a flush fashion to the side face of the disk-shaped section 33, without damaging the sliding guide depression 36, wherein a frictionally locking connection can be produced between the stop element 40 and the axially extending walls of the sliding guide depression 36*c*.

The stop element 40 projects beyond the support face 43 in the direction of the sliding guide, with the result that the locking element 38 can come to bear merely against the stop element 40 and not against the support face 43. If the locking element 38 engages in the sliding guide, the force is generally applied via linear contact. In the illustrated embodiment, this linear contact is produced between the locking element 38 and the stop element 40, which has a higher degree of strength than the disk-shaped section 33. The application of force to the disk-shaped section 33 by the stop element 40 occurs by means of contact over a surface, with the result that the load at this point is smaller. The disk-shaped section 33 can therefore be produced from a more cost-effective material, and only the stop element 40 has to be provided with relatively high strength. Since the stop element 40 projects beyond the support face 43 in the direction of the sliding guide, it is ensured that the force from the locking element 38 is transmitted exclusively to the stop element 40.

The stop element 40 has, on a side face facing the support face 43, two grooves 41, 42. The first groove 41 connects the first depression 36*a* to the second depression 36*b*, which adjoins the sliding guide depression 36*c*, 40, with the result that the pressure medium is supplied to this second depression 36*b*, and therefore to the corresponding pressure chamber 25, via the first groove 41. The second groove 42 connects the first groove 41 to the sliding guide and therefore ensures the supply of pressure medium thereto, in order to disconnect the mechanical connection between the drive element 13 and the output element 14. The grooves 41, 42 can alternative or additionally be formed in the sliding guide depression 36*c* in the region of the stop element 40.

If the first side cover 15 is produced by means of a non-metal-cutting shaping method or a metal casting method or injection molding method, the bulges 35*a-c* and the corresponding depressions 36*a-c* can be fabricated in a cost-neutral fashion. The first side cover 15 can be manufactured, for example, from a sheet-metal blank by means of a deep drawing method, wherein at the same time the sliding guide depression 36*c* and the support face 43 can be formed with this method. Alternatively, the first side cover 15 together with the sliding guide depression 36*c* can be produced by means of a deep drawing process, and the support face 43 can be formed by stamping in a further working step.

REFERENCE NUMBERS

1 Internal combustion engine
2 Crankshaft
3 Piston
4 Cylinder
5 Flexible drive
6 Intake camshaft
7 Exhaust camshaft
8 Cam
9 Intake gas exchange valve
10 Exhaust gas exchange valve
11 Device
12 Screw
13 Drive element
14 Output element
15 Side cover
16 Side cover
17 Hub element
18 Vane
19 Circumferential wall
20 Projection
21 Belt pulley
22 Central screw
23 Pressure space
24 First pressure chamber
25 Second pressure chamber
26 Advanced stop
27 Retarded stop
28 Central pressure medium line
29 Coaxial pressure medium line
30*ab* Annular groove
31 Space
32 Closure stopper
33 Disk-shaped section
34 Opening
35*abc* Bulges
36*ab* Depression
36*c* Sliding guide depression
37 Receptacle
38 Locking element
39 Radial drilled hole
40 Stop element
41 First groove
42 Second groove
43 Stop face

The invention claimed is:

1. A device for variably adjusting the control times of gas exchange valves of an internal combustion engine, comprising a drive element in driven connection with a crankshaft of the internal combustion engine, an output element in driving connection with a camshaft of the internal combustion engine and is arranged pivotably with respect to the drive element, at least one side cover which is arranged on an axial side face of the output element or of the drive element and is connected in a rotationally fixed fashion to the drive element or the output element and has a disk-shaped section, the disk-shaped section has a sliding guide depression which is open to the drive element or the output element and in which a stop element is arranged, and the sliding guide depression and the stop element form a sliding guide in which a locking element can engage, a base of the sliding guide depression has a planar support face against which the stop element bears, the planar support face is arranged spaced apart from an edge of the sliding guide depression, and a depth of the support face is less than a maximum depth of the sliding guide depression.

2. The device as claimed in claim 1, wherein the depth of the support face is less than a depth in an edge region of the sliding guide depression.

3. The device as claimed in claim 1, wherein the sliding guide depression forms a bulge on a side of the disk-shaped section facing away from the drive element.

4. The device as claimed in claim 1, wherein the stop element is connected in a frictionally locking fashion to the sliding guide depression.

5. The device as claimed in claim 1, wherein the stop element projects beyond the planar support face in a direction of the sliding guide.

6. The device as claimed in claim 1, wherein the stop element has, on a side face bearing against the planar support face, at least one groove for conducting pressure medium.

7. The device as claimed in claim 1, wherein the disk-shaped section the sliding guide depression and the planar support face are formed at a same time as a deep drawn part.

8. The device as claimed in claim 1, wherein the disk-shaped section and the sliding guide depression are formed at a same time as a deep drawn part, and the planar support face is subsequently stamped therein.

* * * * *